United States Patent [19]

Hornstein

[11] 4,242,035

[45] Dec. 30, 1980

[54] APPARATUS FOR CONVERTING A LOADER BUCKET TO A PALLET LOADER

[76] Inventor: Robert L. Hornstein, R.R. 1, Clinton, Minn. 56225

[21] Appl. No.: 30,000

[22] Filed: Apr. 16, 1979

[51] Int. Cl.[3] ..... B66F 9/12

[52] U.S. Cl. ..... 414/724; 37/117.5; 414/912

[58] Field of Search ..... 414/724, 912; 37/117.5, 37/120, DIG. 3, DIG. 12

[56] References Cited

U.S. PATENT DOCUMENTS

| | | | |
|---|---|---|---|
| 2,473,505 | 6/1949 | Brock | 414/912 X |
| 2,500,887 | 3/1950 | Trissler | 37/117.5 |
| 2,613,912 | 10/1952 | Jordan | 414/912 X |
| 2,860,794 | 11/1958 | Paluck | 414/724 X |
| 3,075,661 | 1/1963 | Knutson | 37/117.5 X |
| 3,706,388 | 12/1972 | Westendorf | 37/117.5 X |
| 3,795,070 | 3/1974 | Bronson | 37/117.5 |
| 3,866,342 | 2/1975 | Cooper | 37/117.5 |
| 3,921,837 | 11/1975 | Vandewater | 414/724 |
| 3,966,070 | 6/1976 | Barth | 37/117.5 X |
| 3,975,844 | 8/1976 | Olson | 37/117.5 |
| 4,038,766 | 8/1977 | Felstet | 37/117.5 X |
| 4,125,952 | 11/1978 | Jennings | 414/724 X |
| 4,172,687 | 10/1979 | Schultz | 414/724 |

*Primary Examiner*—Stephen G. Kunin
*Assistant Examiner*—Terrance L. Siemens
*Attorney, Agent, or Firm*—Kinney, Lange, Braddock, Westman and Fairbairn

[57] ABSTRACT

A loader bucket for a front end loader has an elongated flat digging blade portion and an upwardly extending curved scoop portion. Apparatus for converting such a loader bucket into a pallet loader includes two identical tine harnesses. Each such harness includes a flat tine and a chain attached to the rear of the tine. A jam cleat is integral with the top side of an intermediate portion of the tine, and includes a cleat arm adapted to overlie a leading edge of the flat digging blade portion of the bucket when the upper surface of the tine from the intermediate portion to the rear thereof is in contact with the underside of the flat blade portion. A load binder is connected between the chain and the intermediate portion of the tine when the load binder is in elongated open position. The load binder can be closed to shorten it to firmly clamp the tine to the underside of the flat digging blade portion of the loader bucket while clamping firmly around the scoop portion thereof.

5 Claims, 6 Drawing Figures

APPARATUS FOR CONVERTING A LOADER BUCKET TO A PALLET LOADER

BACKGROUND OF THE INVENTION

This invention has relation to an attachment which can be readily fastened to a bucket on a front end loader to provide a pair of tines so that the combination can perform as a pallet loader or a fork lift truck or the like.

A typical front end loader is provided with a bucket or scoop shovel adapted for loading various types of farm materials, for example. Often there is a need for an implement to lift pallets, bales, or the like, which require forwardly extending parallel tines such as found on the typical fork lift truck. The need for the scoop shovel attachment in a farm environment, for example, is much greater, or at least, much more frequent that the need for the fork lift or pallet loader tines, in a typical situation. Therefore, in such situations it is typically economically impossible or at least unsound to have on hand a vehicle dedicated primarily to use as a pallet loader or fork lift truck. Instead, a need exists for apparatus which will rapidly allow the scoop shovel or loader bucket of a front end loader to be converted for use as a pallet loader. This conversion should occasion a minimum of down time, should be easily reversible to convert back to loader bucket use, should not necessitate permanent attachments or fixtures on the loader bucket which can be damaged or fouled with loaded materials during loader bucket use, and should be usable on a wide range of sizes and shapes of buckets.

Prior art attempts have been made to provide such structures. The patent to Trissler, U.S. Pat. No. 2,500,887, granted in March of 1950, shows a tractor blade fork consisting of two fork lift arms or limbs 9 which are simply hooked over the top of the bulldozer blade. The patent to Brock, U.S. Pat. No. 2,473,505, granted in June of 1949, shows a pair of lifting tines 40 which can be attached and detached from bulldozer blades, but which require elaborate built-in modifications of the bulldozer blades. These tines are of no value as far as being attachable to any scoop shovel or blade which is not modified to receive them.

Fork lift loader attachments which are more or less permanently attached to bulldozer blades, scoop shovels or the like, include the patent to Knutson, U.S. Pat. No. 3,075,661, granted in Jan. of 1963; the patent to Bronson, U.S. Pat. No. 3,795,070, granted in March of 1974; the patent to Olson, U.S. Pat. No. 3,975,844, granted in August of 1976; and the patent to Felstet, U.S. Pat. No. 4,038,766, granted in August of 1977. They are not believed particularly pertinent in the present invention.

Patents which show fork lift attachments which can be utilized on a front end loader only after the bucket is removed are the patent to Barth, U.S. Pat. No. 3,966,070 granted in June of 1976; and the patent to Paluck, U.S. Pat. No. 2,860,794 granted in September of 1956.

A patent which includes a pair of permanently mounted brackets along the top of a loader bucket for the reception of fork members is the patent to Vandewater, U.S. Pat. No. 3,921,837, granted in November of 1975.

The patent to Cooper, U.S. Pat. No. 3,866,342, granted in February of 1975, shows the use of chains to hook a large pivotally mounted snowplow attachment to a front end loader bucket to be lifted by it.

None of the structures shown in any of these patents or any combination of these structures anticipates the simple structure of the present invention which will allow fork lift tines to be firmly and fixedly attached to loader buckets of virtually any shape to convert the front end loader to use as a pallet loader or fork lift truck; and which can be substantially instantaneously removed from that bucket to leave the bucket entirely unemcumbered of any apparatus related to its pallet loader use.

The patents referred to above were located in a search of the prior art. Applicant and those in privity to him know of no closer prior art than that set out above; and they know of no prior art which anticipates the claims made in this application.

BRIEF SUMMARY OF THE INVENTION

The apparatus of the invention includes at least one tine harness made up of an elongated tine having a chain or other flexible elongated fastening member attached to a rear portion thereof and adapted to extend up and around the scoop portion of a loader bucket or scoop shovel. A load binder or other over center fastening device is adapted to be connected to an intermediate portion of the tine and to the chain to hold the chain and the upper surface of the tine tightly clamped in fixed relationship with respect to the loader bucket.

In the form of the invention shown there are two tines and each tine is fixedly positioned with respect to the forward cutting or digging edge of the loader bucket by a cleat extending integrally upwardly from the top surface of an intermediate portion of the tine and back over the leading edge of the bucket. As the load binder is closed to shorten it, it tightens the chain tending to draw the cleat more tightly onto the leading edge of the loader bucket. The loader bucket itself tends to flex slightly to allow the load binder to be closed and this resilience of the loader bucket tightly holds each tine in place during its operation as a pallet loader or fork lift attachment.

IN THE DRAWINGS

DESCRIPTION OF PREFERRED EMBODIMENT

Figure 1:
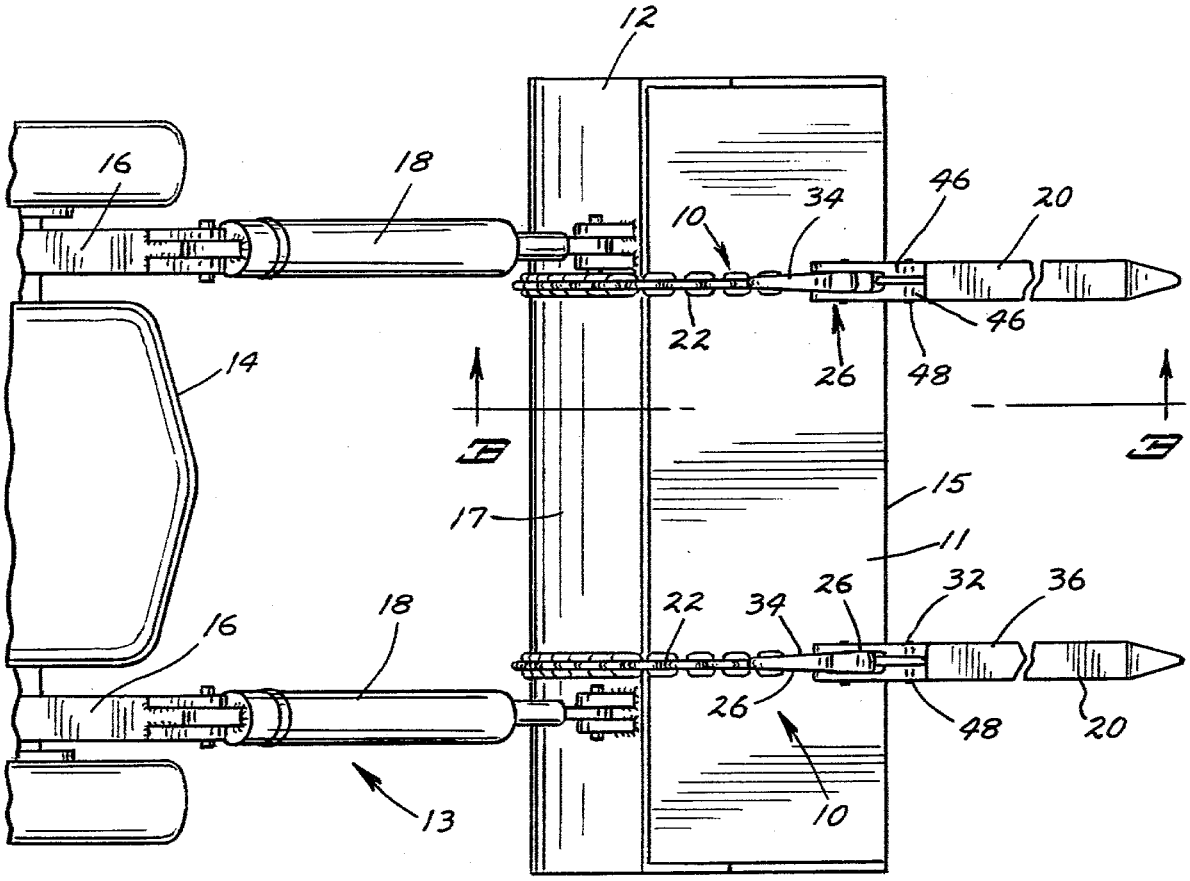
FIG. 1 is a top plan view of the apparatus of the invention shown mounted on a loader bucket of a front end loader.
Figure 2:
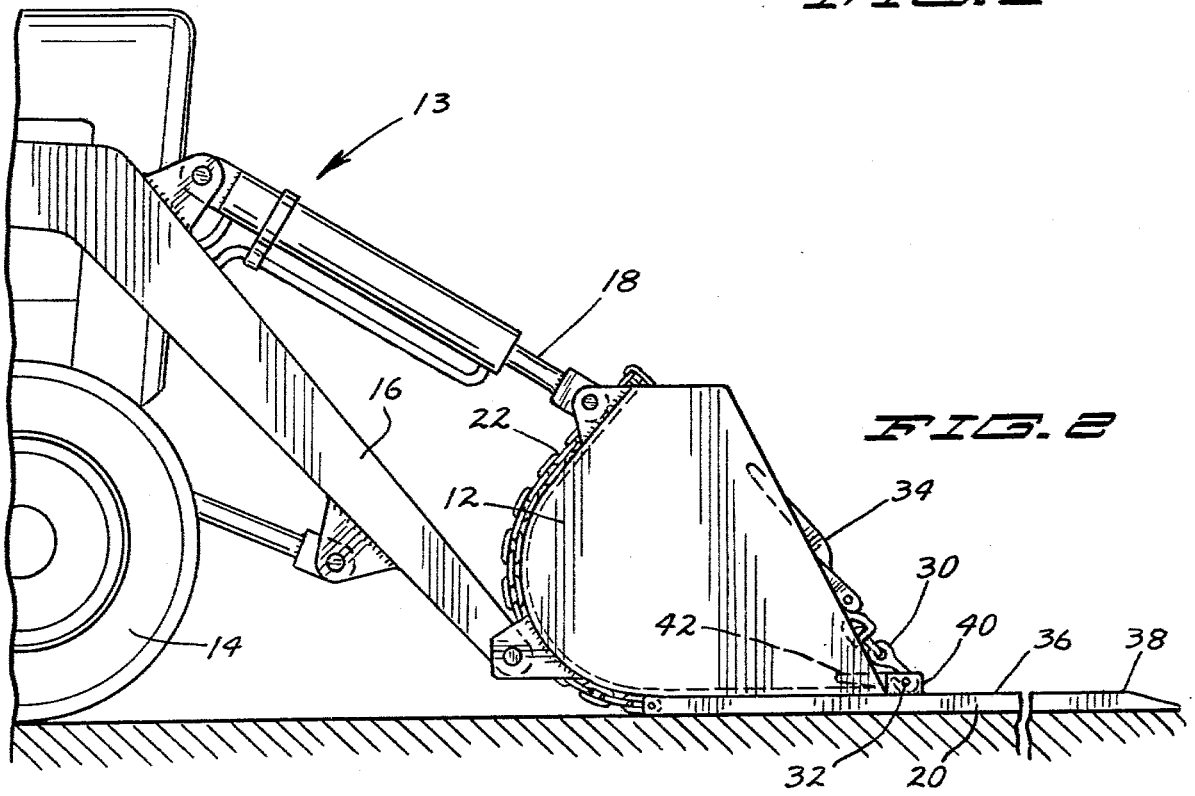
FIG. 2 is a side elevational view of the apparatus and of the loader bucket and the portion of the front end of a tractor of the loader.

As shown, the apparatus of the invention consists of two identical lift truck tine harnesses 10,10 adapted to be attached to a loader bucket 12 or to any other similar loader bucket having a scoop portion 17 and a relatively flat digging blade portion 11. The blade 11 has a leading edge 15.

In the form of the invention as shown, loader bucket 12 is part of a front end loader 13 which includes a tractor 14, a pair of hydraulically operated lift arms 16,16; a pair of linear hydraulic motors 18,18 for controlling the angle of the loader bucket, and appropriate pivotal connections between the loader bucket 12, the hydraulic motors 18,18, and the lift arms 16,16.

Each lift truck tine harness includes a tine 20, a chain 22 or other flexible elongated fastening member connected to a rearward portion of the tine 20 as at 24; and a load binder 26 or other fastening device.

Load binder 26 includes a first hook 28 adapted to fit into one link of the chain 22, a second hook 30 adapted to attach to an intermediate portion of the tine 20 as at 32; and an over-center mechanism of any usual or preferred construction but including a locking handle 34.

An upper surface 36 of the tine 20 is substantially flat except for a forward tip 38 thereof which tapers downwardly. At an intermediate portion of this upper surface, a jam cleat 40 is welded to the tine. This cleat includes a rearwardly extending cleat arm 42, the underside of which is tapered from a rearward dimension large enough to receive the leading edge 15 of the thickest digging blade 11 of a loader bucket which it is to encounter to a small enough dimension to tightly hold the leading edge of the thinnest loader bucket digging blade which it is likely to encounter.

Figure 3:
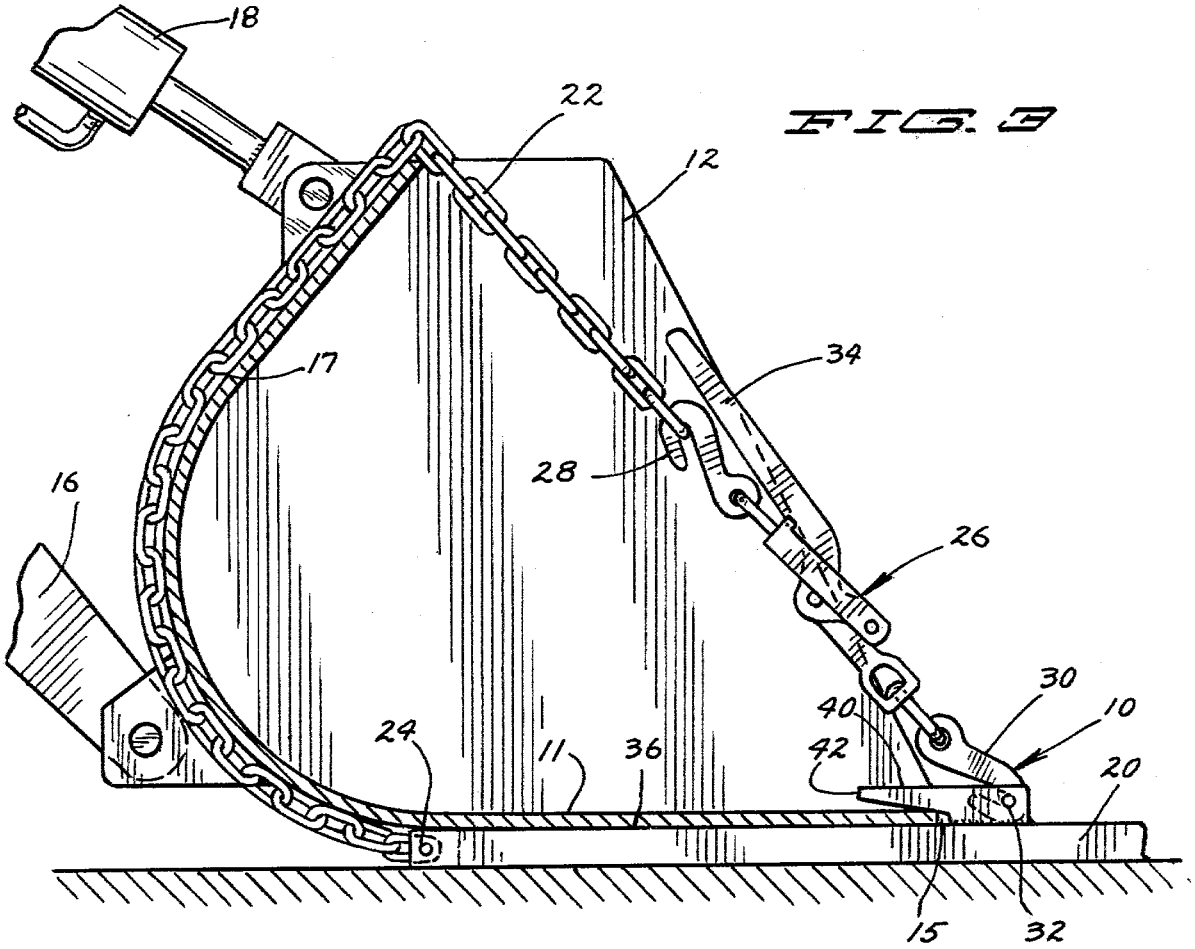
FIG. 3 is an enlarged vertical sectional view taken on the line 3—3 in FIG. 1.
Figure 4:
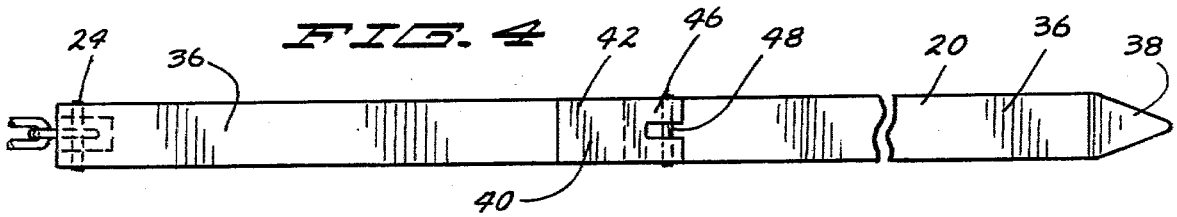
FIG. 4 is a top plan view of one of the two tines of the apparatus of the invention.
Figure 5:
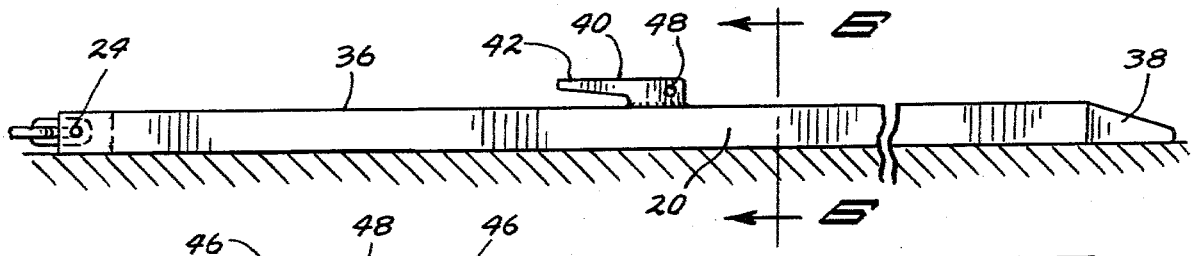
FIG. 5 is a side elevational view of the tine of FIG. 4.
Figure 6:
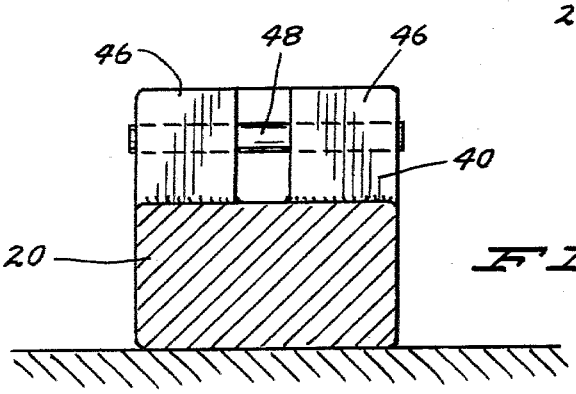
FIG. 6 is an enlarged vertical sectional view taken on the line 6—6 in FIG. 5.

The cleat 40 also includes a pair of spaced-apart forwardly extending ears 46,46 which are provided with openings therethrough to support a load binder receiving pin or member 48. As best seen in FIG. 3, this pin receives the second hook 30 of the load binder 26 when the apparatus is operably positioned on a loader bucket. The cleat could, instead, be provided with a top plate over part of the ears 46,46; and the hook 30 could be hooked onto this plate.

In order to install the harnesses 10 on a loader bucket such as loader bucket 12, one of the tines 20 is positioned underneath the digging blade 11 with the cleat 40 hooked over the forward edge portion 15 of the digging blade 11 in the position as most clearly seen in FIG. 3. This can easily be accomplished, for example, by utilizing the lift arms 16 and the hydraulic motors 18 to position the loader bucket 12 up off of the ground and with the flat portion of the digging blade 11 in a position as close to vertical as possible.

With the tine positioned as set out above, the chain 22 will be looped around the scoop portion 17 of the loader bucket 12, the second hook 30 of the load binder will be hooked over load binder receiving pin 48 of the jam cleat 40, the locking handle 34 of the load binder will be moved in clockwise direction as seen in FIG. 3 to open the binder. The first hook 28 will then be hooked in an appropriate link near the end of the chain 22, and the locking handle 34 of the load binder will be moved in counterclockwise direction to tightly bind the tine 20 in place with its upper surface 36 firmly in contact with the bottom surface of the flat portion of the digging blade 11.

This procedure is repeated with the second tine harness 10. Care is taken to insure that each tine harness is fastened at approximately the same distance from the center line of the bucket as is the other. A distance of 30" (76 cm.) between the tines is optimum for utilization as a pallet loader or in other fork lift service.

Once the tine harnesses are so established, the bucket is manipulated by use of the lift arms and motors to manipulate the tines 20,20 as the fork of a pallet loader or the like.

The embodiments of the invention in which an exclusive property or privilege is claimed are defined as follows:

1. Apparatus for converting a loader bucket into a pallet loader, said bucket having an elongated flat digging blade portion integral with an upwardly extending curved scoop portion, said apparatus including: at least one tine harness, said harness including:

A. an elongated tine, said tine being flat at least from a rearward portion to an intermediate portion thereof;

B. a flexible elongated fastening member attached to a rearward portion of said tine;

C. means for fixedly positioning an intermediate portion of said tine with respect to a leading edge of said bucket digging blade portion;

D. a fastening device, said device being adapted to move from an elongated open position to a shortened closed position;

E. means for attaching said device to a portion of said fastening member spaced from said rearward portion of said tine and means for attaching said fastening device to said intermediate portion of said tine when said tine is positioned under said flat digging blade portion of said bucket, said fastening member is extended over said scoop portion of said bucket, said intermediate portion of said tine is fixedly positioned with respect to the leading edge of said bucket, and said fastening device is open; and F. said fastening device being operable from said open to said closed position to firmly clamp said tine from said intermediate portion to said rearward portion to the underside of said flat digging blade portion.

2. The apparatus of claim 1 wherein:

G. said means for fixedly positioning the intermediate portion of said tine with respect to the leading edge of said bucket is constituted as a cleat integral with said intermediate portion of said tine and having a rearwardly extending cleat arm overlying a rearwardly extending portion of said tine, the relationship of the parts being such that said bucket leading edge portion is adapted to be received snugly between said cleat arm and said upper portion of said tine.

3. The apparatus of claim 2 wherein:

H. said elongated fastening member is constituted as a chain; and

I. said fastening device is constituted as a load binder having a handle to move it between said open and closed positions, said means for attaching said load binder to said chain and to said tine including hooks at the outer ends of said load binder.

4. The apparatus of claim 3 wherein:

J. said means for attaching said load binder to said tine includes a load binder receiving member integral with said intermediate portion of said tine; and K. one of said load binder hooks is adapted to fit into one of the links of said chains, the other of said hooks being adapted to hook into said load binder receiving member.

5. The apparatus of claim 4 wherein:

L. said apparatus for converting a loader bucket into a pallet loader includes at least two harnesses each including the structures as set out in claim 4, each said harness adapted to be spaced the same distance from one of the outer ends of the loader bucket as the other is spaced from the other of said ends.

* * * * *